United States Patent [19]

Shermer

[11] 4,304,354

[45] Dec. 8, 1981

[54] DRAWER ORGANIZER

[76] Inventor: Robert M. Shermer, 5800 SW 113 St., Miami, Fla. 33156

[21] Appl. No.: 170,819

[22] Filed: Jul. 17, 1980

[51] Int. Cl.[3] ..... A47B 88/20; B65D 5/48; B65D 5/54

[52] U.S. Cl. ..... 229/42; 206/45; 206/223; 220/22; 312/259; 312/330 R; 312/351; 312/126; 211/128

[58] Field of Search ..... 206/223, 45; 229/42; 220/22; 312/258, 259, 278, 330, 351, 126; 211/128

[56] References Cited

U.S. PATENT DOCUMENTS

| | | | |
|---|---|---|---|
| 1,587,935 | 6/1926 | Brunhoff | 312/126 |
| 1,671,998 | 6/1928 | Rose | 206/45 |
| 2,103,241 | 12/1937 | Bell | 206/45 |
| 2,217,953 | 10/1940 | Igou | 206/45 |
| 2,268,637 | 1/1942 | Bernstein | 312/330 |
| 2,560,161 | 7/1951 | Fay et al. | 211/128 |
| 2,665,808 | 1/1954 | McAlister | 220/22 |
| 2,800,223 | 7/1957 | Kirk | 220/22 |
| 3,703,326 | 11/1972 | Riviers | 312/330 |

*Primary Examiner*—William T. Dixson, Jr.
*Attorney, Agent, or Firm*—Nathaniel A. Humphries

[57] ABSTRACT

A drawer organizer unit is formed of four stacked rectangular cardboard panels secured together in selected areas by adhesive with fold lines permitting the insertion of lugs extending from the rear edges of the panels into retention apertures of the panel immediately therebeneath so as to permit erection of the unit. Tear lines adjacent the side edges of the unit permit an easy reduction in the width of the unit. The erected unit has canted steplike support surfaces whereas the unit is collapsible into a flat array for storage and/or shipping.

7 Claims, 5 Drawing Figures

Fig-3
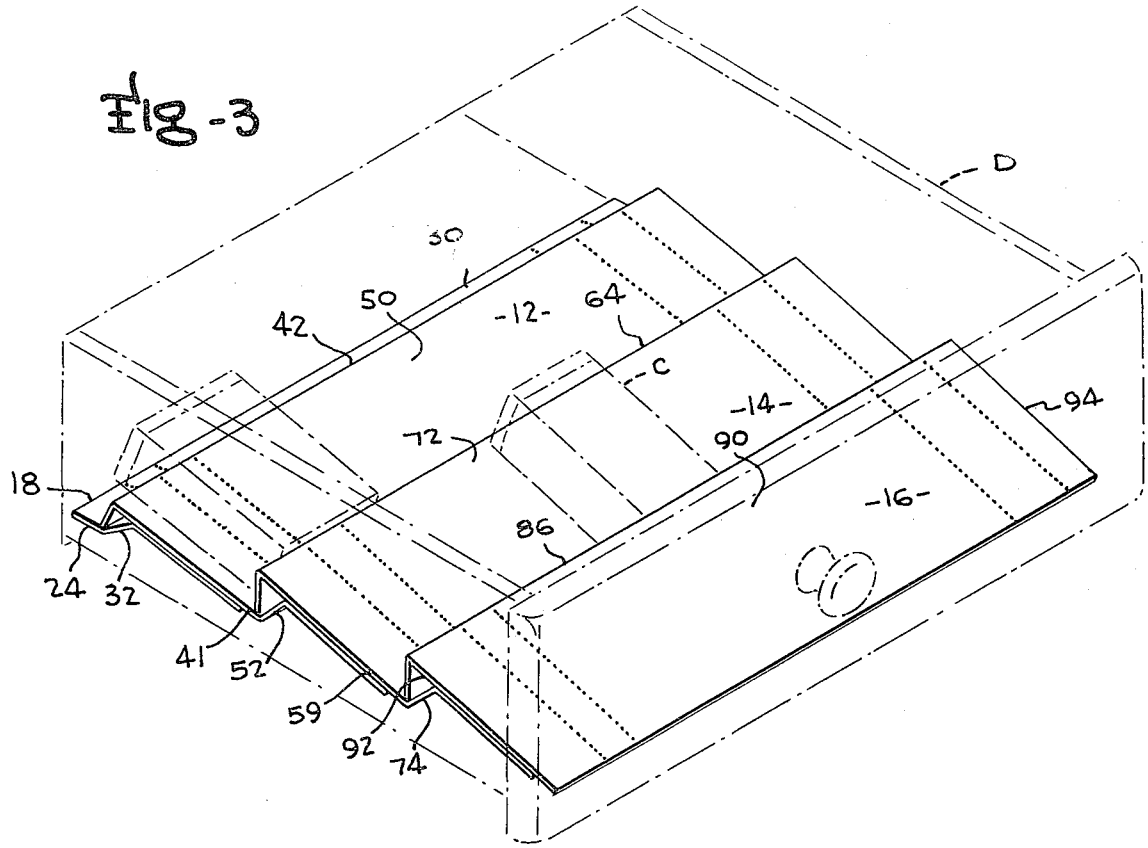
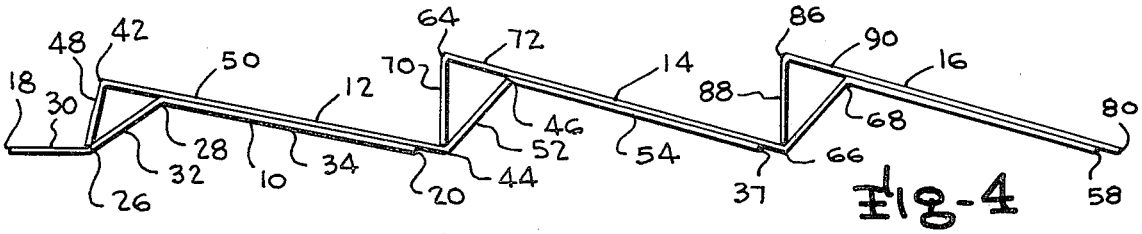
Fig-4
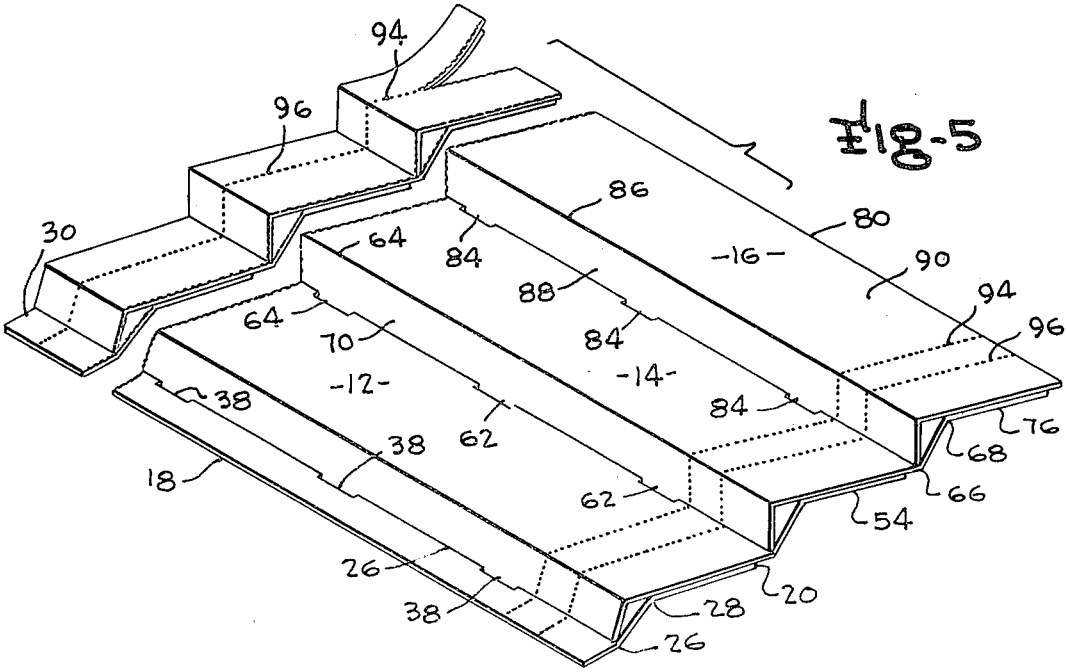
Fig-5

DRAWER ORGANIZER

BACKGROUND OF THE INVENTION

This invention is in the field of kitchen or home accessories and is more specifically directed to a drawer organizer positionable in a drawer for permitting the organization and retention of spice containers or the like in an orderly manner therein.

Numerous devices have been proposed in the past for permitting the orderly positioning of small containers or items, such as spice containers, spools or the like, in a drawer or cabinet for maintaining such items in a desired known location to permit ease of selection and use of individual items while also presenting an attractive and pleasing appearance. Unfortunately, the prior known devices, such as exemplied in U.S. Pat Nos. 2,263,255; 2;303,098; 1,917,005; 2,789,700; 3,000,510; 3,236,371; 3,300,055; 3,499,540; 3,661,271; 3,703,326; 3,708,709; 3,834,778; 3,838,266; 2,234,032; 2,283,890 and 1,951,695 have suffered from a number of disadvantages. For example, many of the prior known devices have been overly complicated and consequently expensive to manufacture and difficult to assemble. Others have been bulky and/or of relatively fragile construction and consequently difficult to mail so as to preclude their sale by mail order or similar merchandising approaches.

Yet another problem frequently found in the prior known devices in this field is that they are of fixed dimensions and are incapable of usage in areas having reduced space restrictions.

Therefore, it is the primary object of this invention to provide a new and improved organizer of particular use in a drawer, such as a spice drawer.

Yet another object of the present invention is the provision of a new and improved organizer which is economical to construct, easy to assemble and can be mailed or shipped with a minimum of difficulty or danger of damage.

Yet another object of the present invention is the provision of a new and improved organizer which has the capability of being dimensioned to fit in drawers of various sizes.

SUMMARY OF THE INVENTION

Achievement of the foregoing objects is enabled by the preferred embodiment of this invention through the provision of a stacked array of rectangular cardboard panels which have longitudinally extending fold lines and positioning lugs extending outwardly of a rear edge surface positionable in retention apertures in the panel positioned immediately therebelow. The fold lines and apertures are positioned so that the panels can be maintained in a planar overlapping relationship for shipment but can be easily assembled by bending along selected fold lines and insertion of the positioning lugs in the retaining apertures in a matter of a few seconds.

An additional feature of the preferred embodiment comprises the provision of parallel serration lines extending inwardly but adjacent the side edges of the panels for permitting a severance of end portions therefrom in order to permit the remaining portions to be positioned in a narrower drawer or the like.

A better understanding of the preferred embodiment will be achieved when the following detailed description is considered in conjunction with the appended drawings in which like reference numerals are used in the different figures for illustration of the same component parts of the preferred embodiment.

BRIEF DESCRIPTION OF THE DRAWINGS

FIG. 3 is a perspective view of the preferred embodiment in its erected condition and positioned in a drawer in a normal mode of use;

FIG. 4 is a side elevation view from the left side of the preferred embodiment in the erected condition as in FIG. 3; and FIG. 5 is a rear perspective view of the erected preferred embodiment illustrating the manner in which side portions can be removed for reducing the width of the item by snapping off or cutting with a knife of scissors.

DESCRIPTION OF THE PREFERRED EMBODIMENT

Figure 1:
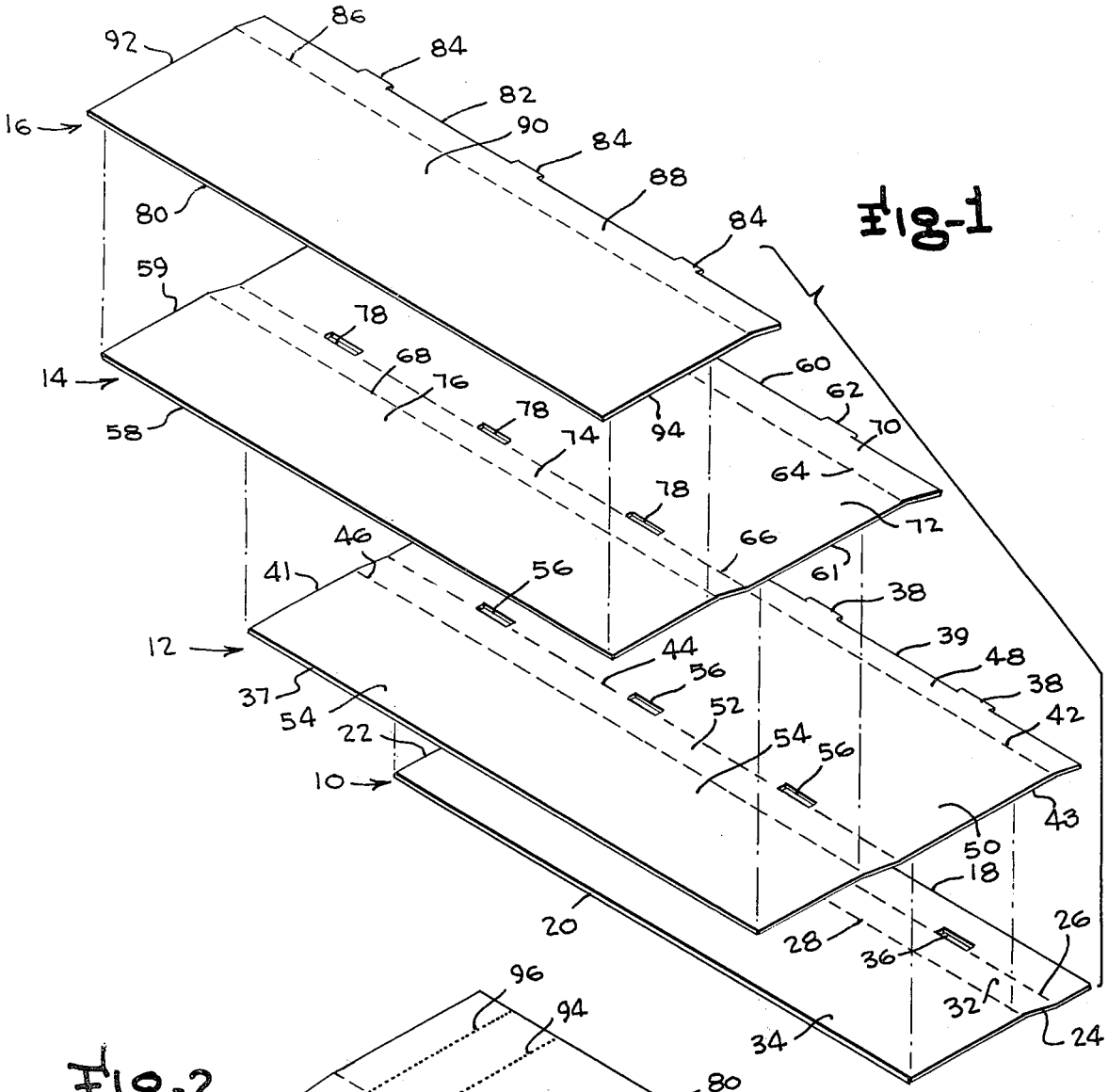
FIG. 1 is an exploded perspective view of the components of the preferred embodiment as viewed from the front thereof.

The preferred embodiment of this invention is formed of four primary components comprising a first relatively rigid cardboard panel 10, a second relatively rigid cardboard panel 12, a third relatively rigid cardboard panel 14 and a fourth relatively rigid cardboard panel 16, each of which is of elongated rectangular configuration. Selected areas of the cardboard panel are secured together by adhesive or other means to provide a unitary construction as will be discussed hereinafter.

The longer edges of the first cardboard panel 10 comprise a rear edge 18 and a front edge 20 with the shorter edges comprising a left edge 22 and a right edge 24. A first fold line 26 and a second fold line 28 extend longitudinally of the first panel 10 and divide the first panel into a first longitudinally extending area 30, a second longitudinally extending area 32 and a third longitudinally extending area 34. Additionally, three rectangular retention apertures 36 are provided adjacent the first fold line 26.

The second cardboard panel 12 includes a front edge 37 and a rear edge 39 joined by side edges 41 and 43 with three positioning lugs 38 extending rearwardly of the rear edge 39 and dimensioned and positioned to be insertable in retention apertures 36 of first panel 10. Additionally, first, second and third fold lines 42, 44 and 46 serve to divide the second panel into first, second, third and fourth longitudinally extending areas 48, 50, 52 and 54. It should also be noted that three retention apertures 56 are provided adjacent the second fold line 44.

The third cardboard panel 14 is identical to the second cardboard panel 12 and includes front and rear edges 58 and 60 and side edges 59 and 61 with the rear edge 60 including three positioning lugs 62 dimensioned and positioned so as to be insertable in the retention apertures 56 of the second panel 12. Also, the third panel 14 includes first, second and third fold lines 64, 66 and 68 which divide the third panel into first, second, third and fourth longitudinally extending areas 70, 72, 74 and 76 respectively. Also, three retention apertures 78 are provided adjacent the second fold line 66.

The fourth cardboard panel 16 includes a front edge 80 and a rear edge 82 with the rear edge 82 including three positioning lugs 84 positioned and dimensioned to be matingly received in the retention apertures 78 of the third panel 14. Additionally, the fourth panel 16 includes a fold line 86 which divides the panel into a first longitudinally extending area 88 and a second longitudinally extending area 90. The fourth panel 16 also includes left and right side edges 92 and 94.

Figure 2:
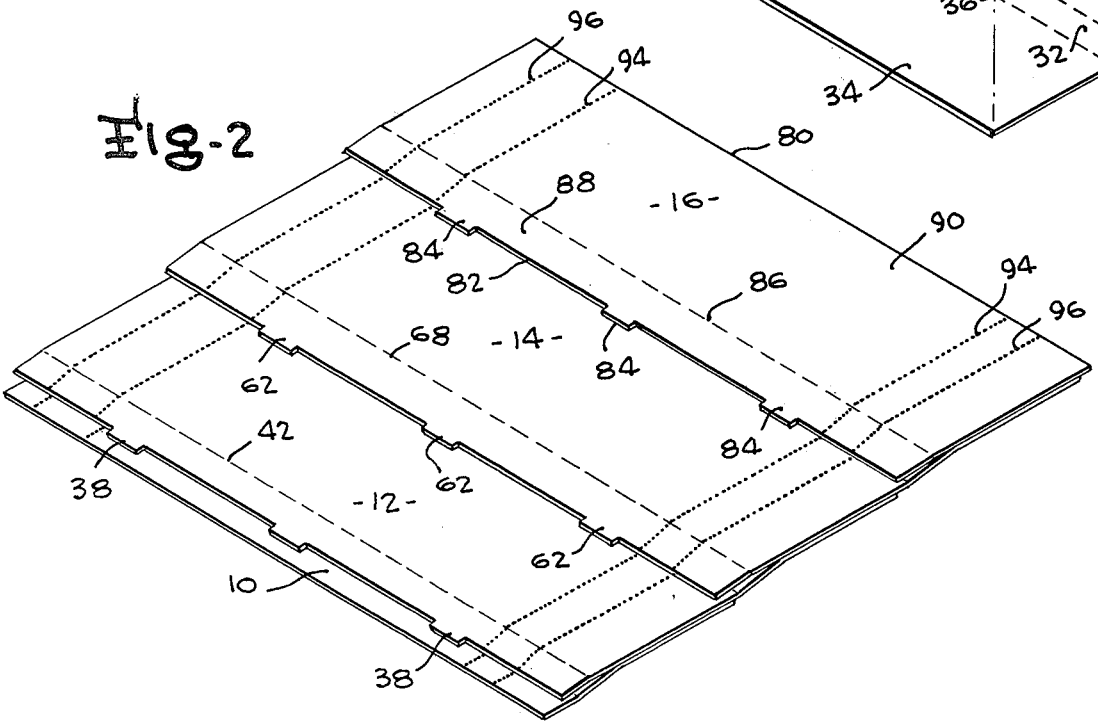
FIG. 2 is a perspective view of the preferred embodiment as viewed from the rear thereof with the component panel parts being in planar non-erected condition such as for shipment.

The four cardboard panels are held in position by adhesive or other securing means. In the preferred construction, the upper surface of the fourth area 76 of third panel 14 is adhesively secured to the lower surface of the forward portion of the second area 90 of the fourth panel 16 with the upper surface of the fourth area 54 of second panel 12 being similarly adhesively secured to a forward portion of the lower surface of second area 72 of the third panel 14. In like manner, the upper surface of third area 34 of the first panel 10 is adhesively secured to a forward portion of the second area 50 of the second panel 12. The assembled unit is shown in FIG. 2 in its knocked-down or unerected condition in which it is maintained for shipment or storage. Inner and outer tear lines 94 and 96 can be provided adjacent the right and left sides of the unit for removal of side edge portions in the event the unit is to be positioned in a drawer or other space having a width less than that of the total width of the unit as illustrated in FIG. 2.

Assembly of the organizer is effected by bending the fourth panel 16 along fold line 86 to effect positioning of the positioning lugs 84 in the retention apertures 78 of the third panel 14. Similarly, the third panel 14 is bent along fold lines 68, 66 and 64 to effect positioning of the positioning lugs 62 in the retention apertures 56 of the second panel 12. The second panel 12 is bent along lines 46. 44 and 42 to effect positioning of the positioning lugs 38 in the retention apertures 36 of the first panel 10. The first panel 10 is bent along fold lines 26 and 28 in the manner illustrated in FIG. 4 which illustrates the erected organizer as viewed from the left edge.

The entire device can be positioned in a drawer D or other similar area as illustrated in phantom in FIG. 3 so that the upper surface areas 50, 72 and 90 provide a canted support surface for supporting spice cans or the like C as clearly illustrated. It should be observed that the number of panels employed in the device can be varied to provide for additional support surfaces if desired. Also, the preferred embodiment can be trimmed with a knife or scissors along lines 94 or 96 to reduce the width of the device so as to make it positionable in drawers having less width than drawer D. The width could also be reduced by snapping or breaking along lines 94 or 96.

An extremely significant aspect of the present invention illustrated in FIG. 2 is the fact that it can be maintained in the condition shown in said Figure for purposes of storage or shipping with the eventual user bending the panels and manipulating them to erect the device into the finished item of FIGS. 3 and 4. Only a minimum amount of manual dexterity is required for assembling the device.

Numerous modifications of the preferred embodiment will undoubtedly occur to those of skill in the art; for example, the device could be made of plastic or other material in place of cardboard and it should therefore be understood that the spirit and scope of the invention is to be limited solely by the appended claims.

I claim:

1. A drawer organizer comprising:

a first relatively rigid panel of rectangular configuration including front and rear edges extending along its longer dimension, first and second spaced parallel fold lines respectively positioned parallel to and adjacent the front and rear edges of the first panel so as to divide said first panel into first, second and third areas extending the length of the longer dimension of said first panel and a plurality of retention apertures provided adjacent said first fold line;

a second relatively rigid panel of rectangular configuration positioned adjacent and immediately above said first panel and including front and rear edges extending along the longer dimension of said second panel, a plurality of lugs protruding from said rear edge thereof and dimensioned and positioned to be insertable in individual ones of said plurality of retention apertures provided in said first panel, first, second and third parallel fold lines in said second rectangular panel extending parallel to the longer dimension of said second panel from rear to front respectively thereof so as to divide said second panel into first, second, third and fourth areas extending along the longer dimension thereof from rear to front and a plurality of retention apertures positioned adjacent said second fold line;

a third relatively rigid panel of rectangular configuration positioned adjacent and immediately above said second panel and including front and rear edges extending along the longer dimension of said third panel, a plurality of lugs protruding from said rear edge of said second panel positioned and dimensioned to be received in individual ones of said retention apertures in said second panel, first, second and third parallel fold lines extending parallel to the longer dimension of said third panel from rear to front respectively so as to divide said third panel into first, second, third and fourth areas extending along the longer dimension from rear to front and a plurality of retention apertures positioned adjacent said second.fold line; and a fourth panel of rectangular configuration including front and rear edges extending along the longer dimension of said fourth panel, a plurality of positioning lugs extending outwardly of said rear edge thereof, said positioning lugs being dimensioned and positioned so as to be insertable in individual ones of the retention apertures of said third panel;

wherein said first, second, third and fourth panels each have upper and lower surfaces and further including means for securing the upper surface of the fourth area of the third panel to a forward portion of the lower surface of the second area of the fourth panel, means for securing the upper surface of the fourth area of the second panel to the lower surface of a forward portion of the second area of the third panel and means for securing the upper surface of the third area of the first panel to a forward portion of the second area of the second panel.

2. A drawer organizer as recited in claim 1 wherein said first, second third and fourth relatively rigid panels are formed of cardboard.

3. A drawer organizer as recited in claim 1 wherein said first, second, third and fourth relatively rigid panels are formed of cardboard and include tear lines provided adjacent the side edges thereof for permitting an easy removal of side portions to effect a reduction in the width of the organizer.

4. A drawer organizer as recited in claim 1 wherein said first, second, third and fourth relatively rigid panels are formed of cardboard and said retention apertures are rectangular and said lugs are of rectangular cross-section to be matingly received therein.

5. A drawer organizer as recited in claim 4 wherein said first, second, third and fourth relatively rigid panels include tear lines provided adjacent the side edges thereof for permitting an easy removal of side portions to effect a reduction in the width of the organizer.

6. A drawer organizer as recited in claim 1 wherein said first, second, third and fourth relatively rigid panels are formed of plastic.

7. A drawer organizer as recited in claim 6 wherein said first, second, third and fourth relatively rigid panels include tear lines provided adjacent the side edges thereof for permitting an easy removal of side portions to effect a reduction in the width of the organizer.

* * * * *